US008689996B2

(12) United States Patent
Ting et al.

(10) Patent No.: US 8,689,996 B2
(45) Date of Patent: Apr. 8, 2014

(54) SYSTEM FOR LOCKING CONTAINER ASSEMBLY

(75) Inventors: Xu Ting, Shanghai (CN); Kai Fan, Shanghai (CN); Yuan Xia, Shanghai (CN)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 13/572,374

(22) Filed: Aug. 10, 2012

(65) Prior Publication Data

US 2013/0082061 A1 Apr. 4, 2013

(30) Foreign Application Priority Data

Sep. 29, 2011 (CN) ..... 2011 2 0387155

(51) Int. Cl.
*B65D 45/00* (2006.01)

(52) U.S. Cl.
USPC ..... 220/315; 220/325; 220/327; 220/328; 292/267.71; 292/251

(58) Field of Classification Search
USPC ..... 220/582, 325, 324, 328, 327, 315; 292/256.71, 256.73, 256, 251
See application file for complete search history.

(56) References Cited

U.S. PATENT DOCUMENTS

| | | | | |
|---|---|---|---|---|
| 3,572,795 | A * | 3/1971 | Howard et al. | 292/251 |
| 4,467,936 | A * | 8/1984 | Makhijani | 220/246 |
| 4,664,281 | A * | 5/1987 | Falk et al. | 220/3.8 |
| 6,585,128 | B2 * | 7/2003 | Clevenger et al. | 220/303 |
| 7,607,553 | B2 * | 10/2009 | Weber | 220/328 |

* cited by examiner

*Primary Examiner* — J. Gregory Pickett
*Assistant Examiner* — Raven Collins
(74) *Attorney, Agent, or Firm* — Fletcher Yoder, P.C.

(57) ABSTRACT

A system includes a container assembly comprising a cover threadingly coupled to a container along a threaded interface portion of an interface and a cover lock assembly. The cover lock assembly includes a lock screw configured to selectively move between a cover lock position and a cover release position. The lock screw extends across the interface to resist threaded rotation of the cover relative to the container in the cover lock position, and the lock screw is recessed away from the interface to enable threaded rotation of the cover relative to the container in the cover release position. The cover lock assembly also includes a lock insert configured to block movement of the lock screw from the cover lock position to the cover release position.

20 Claims, 4 Drawing Sheets

SYSTEM FOR LOCKING CONTAINER ASSEMBLY

CROSS-REFERENCE TO RELATED APPLICATION

This application claims priority to and benefit of Chinese Patent Application No. 201120387155.7 entitled "SYSTEM FOR LOCKING CONTAINER ASSEMBLY", filed Sep. 29, 2011, which is herein incorporated by reference in its entirety.

BACKGROUND OF THE INVENTION

The subject matter disclosed herein relates to containers. More specifically, the disclosed subject matter relates to a system for locking container assemblies.

A variety of container assemblies house sensitive parts that are intended to be accessible only by authorized personnel in appropriate conditions. For example, in certain explosive environments, an explosion proof container assembly may be used to contain certain electronics, sensors, or equipment, thereby protecting the environment from a potential explosion. By further example, certain container assemblies may include a custody transfer module, which may include monitoring equipment, such as sensors to monitor flow rates, pressures, temperatures, and the like. Thus, the various container assemblies may have certain tamper-proof features to block unauthorized access. Unfortunately, these tamper-proof features may be circumvented and/or lost due to various loose parts.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, A system, includes a container assembly with a cover threadingly coupled to a container along a threaded interface portion of an interface. The system also includes a cover lock assembly. The cover lock assembly includes a lock screw configured to selectively move between a cover lock position and a cover release position. The lock screw extends across the interface to resist threaded rotation of the cover relative to the container in the cover lock position. The lock screw is recessed away from the interface to enable threaded rotation of the cover relative to the container in the cover release position. The cover lock assembly also includes a lock insert configured to block movement of the lock screw from the cover lock position to the cover release position.

In a second embodiment, a system includes an explosion proof container assembly. The explosion proof container includes a container and a cover threaded to the container. The cover includes a lock receptacle having a threaded portion extending to an interface between the container and the cover, a tool insertion portion extending from the threaded portion to a surface opposite from the interface, and a screw stop disposed between the threaded portion and the tool insertion portion. The system also includes a cover lock assembly. The cover lock assembly includes a lock screw disposed in the threaded portion of the lock receptacle. The lock screw is configured to selectively move across the interface to resist rotation of the cover relative to the container, and the screw stop blocks removal of the lock screw through the tool insertion portion.

In a third embodiment, a system includes a cover configured to couple to a container along an interface with a fastening mechanism. The cover includes a lock receptacle having a threaded portion extending to the interface, a tool insertion portion extending from the threaded portion to a surface opposite from the interface, a lateral portion intersecting at least one of the threaded portion or the tool insertion portion, and a screw stop. The system also includes a cover lock assembly separate from the fastening mechanism. The cover lock assembly includes a lock screw disposed in the threaded portion of the lock receptacle. The lock screw is configured to selectively move across the interface to block removal of the cover relative to the container via the fastening mechanism, and the screw stop blocks removal of the lock screw through the tool insertion portion. The cover lock assembly also includes a lock insert with a cable configured to extend through the tool insertion portion and the lateral portion of the lock receptacle. The cable is configured to block a tool from engaging the lock screw through the tool insertion portion of the lock receptacle.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
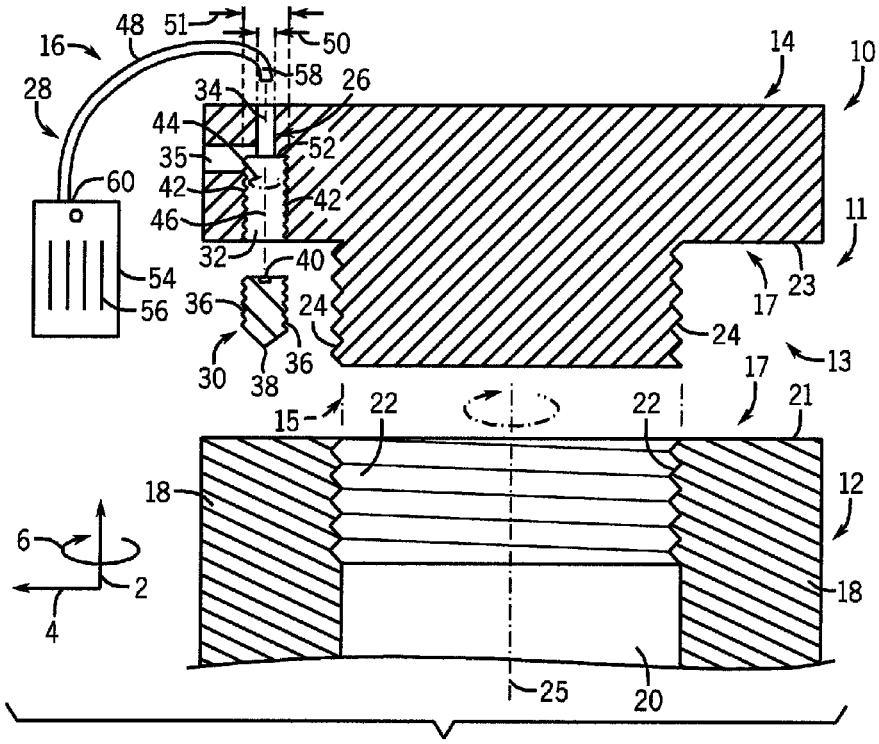
FIG. 1 is a partial cross-sectional side view of an embodiment of a container assembly having a cover exploded from a container, illustrating a cover lock assembly with a lock screw and a lock insert exploded from a lock receptacle in the cover.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments include a cover lock assembly configured to tamper-proof a container assembly, such as an explosion-proof container assembly and/or a custody transfer transmitter assembly. The cover lock assembly includes a setscrew or lock screw, a lock insert such as a tamper-proof cable, and a lock receptacle configured to house the lock screw and the lock insert. For example, the cover lock assembly may be disposed in the cover, the container, or a combination thereof. Although the illustrated embodiments depict the cover lock assembly in the cover for purposes of discussion, various embodiments may include the cover lock assembly in the container using the same features. In either configuration, the lock screw may be self-retained to the lock receptacle (e.g., in the cover), thereby reducing the possibility of losing the lock screw during authorized or unauthorized access to the cover assembly. For example, the lock receptacle may include a screw stop configured to block removal of the lock screw. The lock receptacle also enables insertion of the lock insert, e.g., the tamper-proof cable, to block actuation of the lock screw with a tool. For example, the lock receptacle may be a T-shaped lock receptacle defined by a threaded portion for the lock screw, a tool insertion portion for insertion of the tool to actuate the lock screw, and a lateral portion that intersects the threaded portion and/or the tool insertion portion. In such an embodiment, the lock insert, e.g., tamper-proof cable, may extend through the tool insertion portion and the lateral portion, and form a closed loop to tamper-proof the lock screw. The cover lock assembly is particularly well suited for tamper proofing threaded container assemblies, e.g., cover threaded onto container. However, the cover lock assembly may be used to tamper-proof a variety of other container assemblies, access panels, machinery, and the like.

Turning now to the drawings, FIG. 1 is a partial cross-sectional side view of an embodiment of a container system 10 having a container assembly 11 (e.g., a container 12 and a cover 14) and a setscrew assembly or cover lock assembly 16. As discussed in detail below, the cover lock assembly 16 is configured to tamper-proof the container assembly 11 to block or generally prevent unauthorized access to the container assembly 11. The container 12 and the cover 14 are configured to mate with one another along an interface 13, which includes a threaded interface portion 15 (e.g., a fastener mechanism) and a non-threaded interface portion 17. In the illustrated embodiment, the cover lock assembly 16 is configured to lock the interface 13 along the non-threaded interface portion 17, while other embodiments may lock the interface 13 along the threaded interface portion 15. The cover lock assembly 16 is discussed in further detail below.

The container assembly 11 may have a variety of constructions within the scope of the disclosed cover lock assembly 16. For example, the container assembly 11 may be an explosion-proof container assembly 11 having an explosion-proof container 12 and an explosion-proof cover 14. The container assembly 11 also may be a custody transfer container assembly as discussed in further detail below. Thus, the container assembly 11 may be made of a variety of metals, plastics, ceramics, or a combination thereof. The container assembly 11 also may be substantially or completely sealed with one or more seals, thereby defining a fluid tight, water tight, or air tight volume. In the illustrated embodiment, the container 12 includes containment walls 18 (e.g., an annular wall, cup-shaped wall, or the like), an open containment portion or interior volume 20, a non-threaded interface portion or upper lip portion 21, and a threaded interface portion 22. The cover 14 includes a non-threaded interface portion or outer lip portion 23 and a threaded interface portion 24. Together, the threaded interface portions 22 and 24 represent the threaded interface portion 15 of the interface 13, while the non-threaded interface portions 23 and 25 represent the non-threaded interface portion 17. For purposes of discussion, reference may be made to an axial direction or axis 2, a radial direction or axis 4, and a circumferential axis or direction 6. In the illustrated embodiment, the cover 14 is threadingly coupled to the container 12 by rotating the cover 14 relative to the container 12 along the threaded interface portion 15 (e.g., portions 22 and 24). For example, the cover 14 is rotatable in the circumferential direction 6 about a rotational axis 25 of the container 12.

The cover lock assembly 16 is configured to block unauthorized removal of the cover 14 from the container 12 once the cover 14 is threaded onto the container 12. In the illustrated embodiment, the cover lock assembly 16 includes a lock receptacle 26, a lock insert 28, and a setscrew or lock screw 30. The lock receptacle 26 includes a threaded receptacle portion or setscrew storage chamber 32, a tool insertion receptacle portion or tool access port 34, and a lateral receptacle portion or tamper-proof cable port 35. The lock screw 30 includes male threads 36, an engagement tip 38 (e.g., a conical or pointed tip), and a tool engagement portion 40. For example, the tool engagement portion 40 may include a flat slot-shaped recess, a hex-shaped recess, a square-shaped recess, an X-shaped recess, or any other suitable recess or protrusion that can be drive by a hand-tool or a power tool.

In the illustrated embodiment, the lock receptacle 26 is a T-shaped lock receptacle disposed in the cover 14, wherein the T-shape is defined by the lateral receptacle portion 35 intersecting at least one or both of the threaded receptacle portion 32 and the tool receptacle portion 34. However, the shape and configuration of the lock receptacle 26 may vary across implementations, and the lock receptacle 26 may be disposed in either the cover 14 or the container 12. In certain embodiments, the threaded receptacle portion 32 may be disposed within the container cover 14 or an external extrusion connected to the container cover 14. The threaded receptacle portion 32 includes threaded walls 42 (e.g., female threads) configured to mate with the male threads 36 of the lock screw 30 as the screw 30 is rotated 44 around an axis 46 of the threaded receptacle portion 32. The tool receptacle portion 34 is configured to accept a tool to engage the lock screw 30 via the tool engagement portion 40. The tool receptacle portion 34 has a diameter 50 smaller than a diameter 51 of the lock screw 30 and the threaded receptacle portion 32, thereby defining a screw stop 52 (e.g., a ledge, lip, or transition) between the threaded receptacle portion 32 and the tool receptacle portion 34. For example, the screw stop 52 may represent a flat edge perpendicular to the axis 46. As a result, the screw stop 52 is configured to self-retain the lock screw 30 within the threaded receptacle portion 32 by at least blocking removal of the lock screw 30 through the tool receptacle portion 34. In some embodiments, the lock receptacle 26 may limit movement of the lock screw 30 in both directions along the axis 44, thereby completely self-retaining the lock screw 30 within the threaded receptacle portion 32.

The lateral receptacle portion 35 is configured to receive the lock insert 28, which may include a tamper-proof cable 48. Furthermore, as discussed in detail below, the lock insert 28 (e.g., cable 48) may extend through both the lateral receptacle portion 35 and the tool receptacle portion 34, and further create a closed-loop to ensure self-retention to the cover 14. The lock insert 28 also may include an identification tag 54 coupled to the tamper-proof cable 48. The tag 54 may include various information to identify the authenticity of the tamper-proof cable 48. For example, the tag 54 may include textual information 56, such as a serial number, model number, original equipment manufacturer name, service code, date of manufacture, or other information useful for checking the authenticity of the tamper-proof cable 48. The tag 54 also may include a bar code or various machine readable code. In certain embodiments, the tag 54 may include a smart tag with a chip storing data. As discussed in further detail below, the lock insert 28 may be self-retained to the cover 14 through the lock receptacle 26 by securing opposite ends 58 and 60 of the cable 48 together. For example, the opposite ends 58 and 60 of the cable 48 may be crimped together, welded together, or otherwise fixed together to prevent removal of the lock insert 28.

Figure 2:
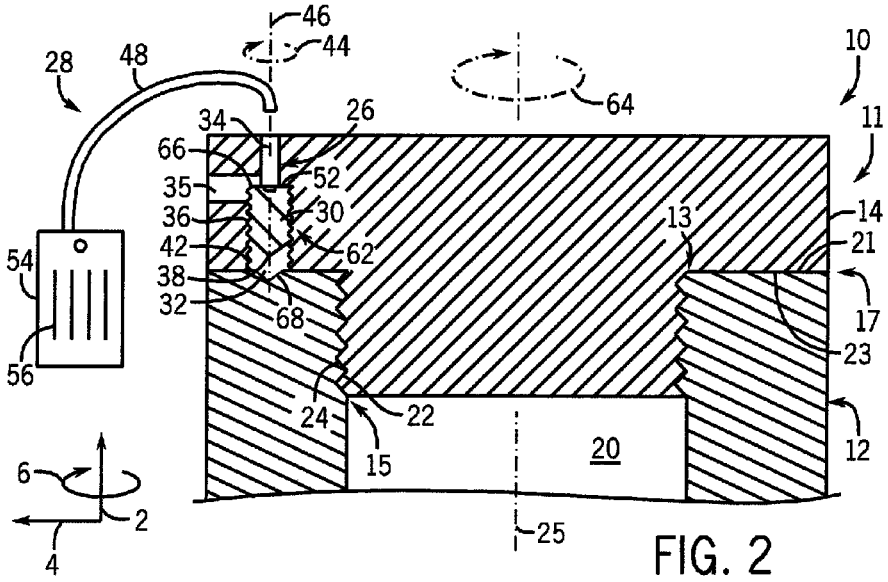
FIG. 2 is a partial cross-sectional side view of the container assembly of FIG. 1, illustrating the cover coupled to the container with the lock screw disposed in the lock receptacle in a cover release position.

FIG. 2 is a partial cross-sectional side view of the container system 10 of FIG. 1, illustrating the cover 14 coupled to the container 12 with the lock screw 30 disposed in the lock receptacle 26 (e.g., the threaded receptacle portion 32) in a cover release position 62. Referring generally to FIGS. 1 and 2, the cover 14 may be threaded onto the container 12 by rotating the cover 14 relative to the container 12, while engaging the threaded interface portion 15 of the interface 13. In particular, the threaded interface portion 24 (e.g., male threads) of the cover 14 may be rotated into threaded engagement with the threaded interface portion 22 (e.g., female threads) of the container 12. As the cover 14 rotates circumferentially 6 about the axis 25 of the container assembly 11 as indicated by arrow 64, the threaded interface portions 22 and 24 pull the cover 14 axially 2 toward the container 12 until the non-threaded interface portions 21 and 23 engage one another as illustrated in FIG. 2. During this engagement (or disengagement) of the cover 14 with the container 12, the cover lock assembly 16 is disengaged with the lock screw 30 in the cover release position 62 and the lock insert 28 separate from the lock receptacle 26.

In the illustrated embodiment, the cover release position 62 of the lock screw 30 is retracted axially 2 into the threaded receptacle portion 32 of the receptacle 26 away from the non-threaded interface portion 17, and further toward the screw stop 52 (e.g., lip or ledge). In particular, FIG. 2 illustrates an upper surface 66 of the lock screw 30 abutted against the screw stop 52 in the cover release position 62. However, the cover release position 62 may correspond to any position of the lock screw 30 having the engagement tip 38 (e.g., conical or pointed tip) recessed away from the non-threaded interface portion 17 (e.g., the non-threaded interface portions 21 and 23), such that the tip 38 does not block rotational movement of the cover 14 relative to the container 12. For example, prior to mating the cover 14 with the container 12, the lock screw 30 is stored in the threaded receptacle portion 32 by rotating 44 the lock screw 30 along the axis 46 of the threaded receptacle portion 32. Once the lock screw 30 is retracted into the threaded receptacle portion 32, the cover 14 is free to rotate 64 onto the container 12. When the cover 14 is completely engaged to container 12 (i.e., non-threaded interface portions 21 and 23 contact one another), the lock screw 30 may be actuated by a tool to drive the lock screw 30 toward the non-threaded interface portion 17 until the engagement tip 38 engages the non-threaded interface portion 21 of the container 12. For example, the engagement tip 38 may deform the non-threaded interface portion 21 of the container 12 to block rotation of the cover 14 circumferentially 6 about the axis 25. In some embodiments, the engagement tip 38 may extend into a lock screw recess 68 in the non-threaded interface portion 21 of the container 12 to block rotation of the cover 14 circumferentially 6 about the axis 25.

Figure 3:
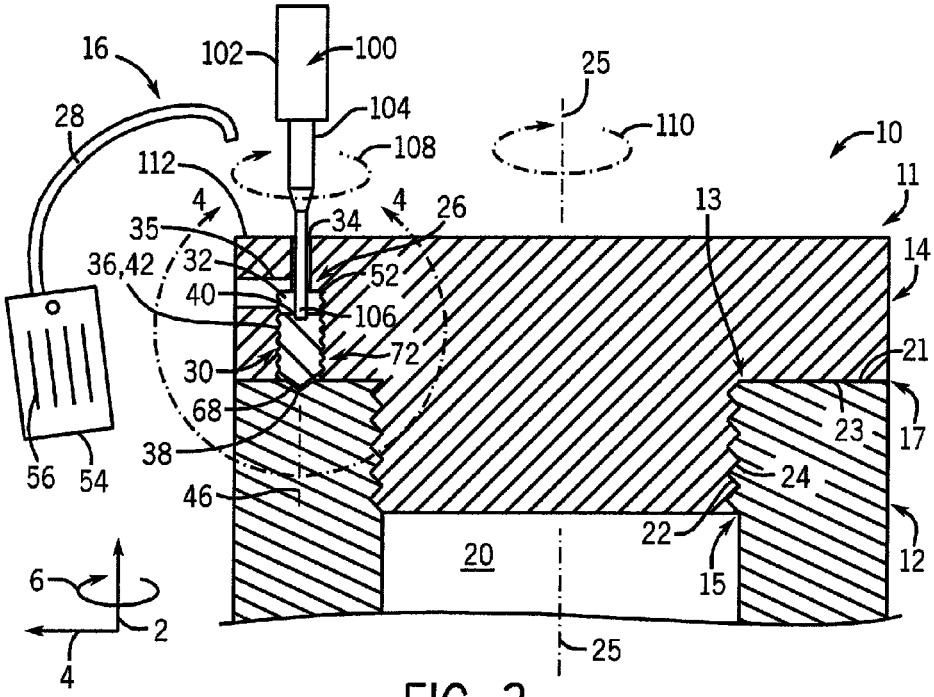
FIG. 3 is a partial cross-sectional side view of the container assembly of FIG. 2, illustrating the cover lock assembly with the lock screw actuated by a tool from the cover release position to a cover lock position.

FIG. 3 is a partial cross-sectional side view of the container system 10 of FIG. 2, illustrating the cover lock assembly 16 with the lock screw 30 actuated by a tool 100 from the cover release position 62 (FIG. 2) to a cover lock position 72. As illustrated, the tool 100 is a hand-operated tool, such as a screw driver or ratchet. In other embodiments, the tool 100 may be a power tool, such as a battery powered drill, battery powered screw driver, or the like. The tool 100 includes a handle 102, a shaft 104, and a screw engagement tip 106. For example, the screw engagement tip 106 may have a flat protrusion, an X-shaped protrusion, a square-shaped protrusion, or a hex-shaped protrusion configured to mate with the tool engagement portion 40 of the lock screw 30. As illustrated, the lock receptacle 26 includes the tool receptacle portion 34 directly above the lock screw 30 disposed in the threaded receptacle portion 32. Accordingly, the tool 100 is able to engage the lock screw 30 while recessed, and substantially self-retained, within the cover 14 by inserting the shaft 104 through the tool receptacle portion 34 until the screw engagement tip 106 fits into the tool engagement portion 40 of the lock screw 30. In response to actuation by the tool 100, the lock screw 30 is configured to selectively move across the interface 13 (e.g., non-threaded interface portions 21 and 23) to resist rotation of the cover 14 relative to the container 12.

Upon engagement of the tip 106 with the tool engagement portion 40, the tool 100 may be actuated (e.g., rotated 108) about the axis 46 to drive (e.g., via threads 36 and 42) the lock screw 30 axially 2 toward the non-threaded interface portion 17 (e.g., portions 21 and 23). Eventually, the engagement tip 38 of the lock screw 30 extends into the non-threaded interface portion 21 of the container 12 to lock the cover 14 in place relative to the container 12. For example, the engagement tip 38 of the lock screw 30 may deform and axially 2 extend into the surface (e.g., interface portion 21) of the container 12 and/or the lock screw 30 may extend into the lock screw recess 68. The lock screw recess 68 (or the container 12 itself) may include a soft metal, e.g., aluminum, capable of being deformed by the tip 38 when pressure is applied. After the tip 38 is disposed in the lock screw recess 68, the lock screw 30 blocks rotation 110 (and thus unthreading) of the cover 14 relative to the container 12 in relation to the axis 25 of the container 12. In particular, when the lock screw 30 is engaged with the lock screw recess 68, the lock screw 30 itself is unable to rotate 110 circumferentially 6 about the axis 25 of the container 12, such that the cover 14 is also locked in place. In the illustrated embodiment, the cover lock assembly 16 is separate from the threaded interface portion 15 and, more specifically, the lock screw 30 engages the non-threaded interface portion 17 rather than the threaded interface portion 15. In other embodiments, the cover lock assembly 16 is separate from the threaded interface portion 15, yet the lock screw 30 may selectively extend across the threaded interface portion 15 to block or disable the threaded interface portion 15 (e.g., block unthreading of the threaded interface portions 22 and 24).

In either case, the lock screw 30 is recessed and self-retained inside the cover 14 while engaged with the lock screw recess 68. For example, the screw stop 52 blocks removal of the lock screw through the tool receptacle portion 34 from the non-threaded interface portion 17 toward a top surface 112 opposite from the interface portion 17. Furthermore, the engagement between the non-threaded interface portions 21 and 23 of the container 12 and the cover 14 blocks removal of the lock screw 30 from the screw stop 52 toward the interface portions 21 and 23. In other words, the lock screw 30 is axially 2 captured between the screw stop 52 and the interface portions 21 and 23. The lock screw 30 is further locked in place within the lock screw recess 68 by the lock insert 28, e.g., the cable 48, as discussed in further detail below.

Figure 4:
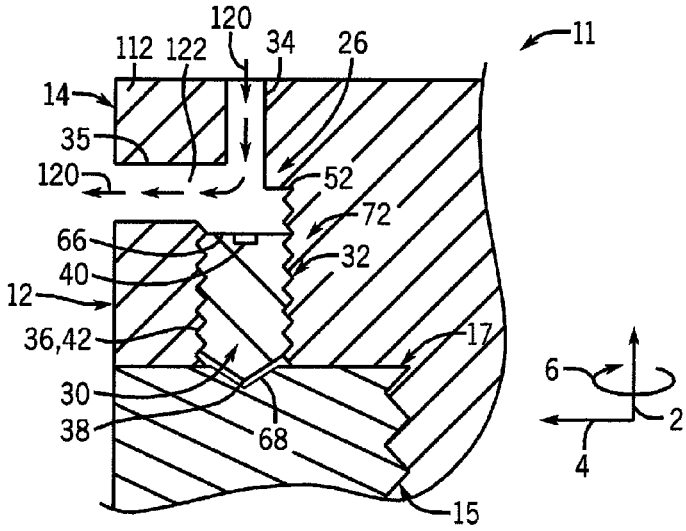
FIG. 4 is a partial cross-sectional side view taken within line 4-4 of FIG. 3, illustrating the lock screw extending across an interface between the cover and the container in the cover lock position.

FIG. 4 is a partial cross-sectional side view taken within line 4-4 of FIG. 3, illustrating the lock screw 30 extending across the interface 13 (e.g., the non-threaded interface portion 17) between the cover 14 and the container 12 in the cover lock position 72. As illustrated, when the lock screw 30 is engaged, the engagement tip 38 is received by the lock screw recess 68. As previously discussed, the contact between the engagement tip 38 and the lock screw recess 68 blocks the cover 14 from circumferential rotation 110, thus blocking the cover 14 from being unthreaded from the container 12. The lock screw 30 can be disengaged by rotating the lock screw 30 via use of the tool 100. However, when the lock screw 30 is fully engaged to fit within the lock screw recess 68, the lock screw 30 opens a pathway 120 through the tool receptacle portion 34 and the lateral receptacle portion 35 of the lock receptacle 26, such that the lock insert 28 (e.g., tamper-proof cable 48) may be inserted above the lock screw 30. In particular, the upper surface 66 and the tool engagement portion 40 of the lock screw 30 are disposed below the screw stop 52 and an intersection or junction region 122 between the tool receptacle portion 34 and the lateral receptacle portion 35 of the lock receptacle 26. In this manner, the tool receptacle portion 34 and the later receptacle portion 35 define the pathway 120 as an L-shaped pathway, such that the lock insert 28 (e.g., tamper-proof cable 48) may be looped through the lock receptacle 26 to prevent tampering with the lock screw 30.

Figure 5:
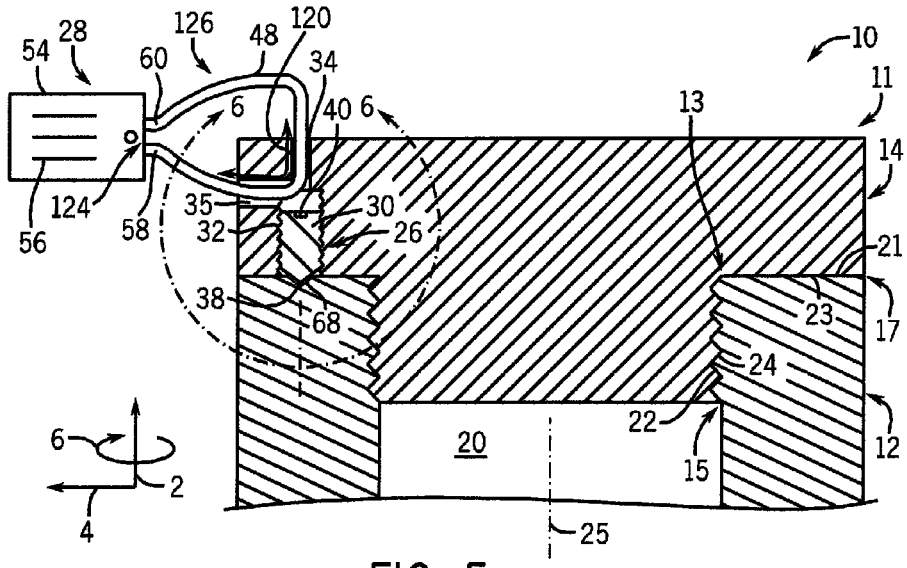
FIG. 5 is a partial cross-sectional side view of the container assembly of FIG. 3, illustrating the cover lock assembly with the lock insert (e.g., tamper-proof cable) extending through the lock receptacle to disable the lock screw.

FIG. 5 is a partial cross-sectional side view of the container system 10 of FIG. 3, illustrating the cover lock assembly 16 with the lock insert 28 (e.g., tamper-proof cable 48) extending through the lock receptacle 26 to disable the lock screw 30. As discussed above, after engagement of the lock screw 30 with the lock screw recess 68 as illustrated in FIGS. 3 and 4, the lock insert 28 (e.g., tamper-proof cable 48) may be installed in the lock receptacle 26 to block any tampering with the lock screw 30, thereby ensuring that the lock screw 30 continued to block removal of the cover 14 from the container 12. In the illustrated embodiment, the tamper-proof cable 48 is fed through the tool receptacle portion 34 and the lateral receptacle portion 35, and opposite ends 58 and 60 are secured together at a connection region 124 to define a closed loop 126. For example, the opposite ends 58 and 60 may be separately affixed to the tag 54 or the ends 58 and 60 may be directly coupled together. As illustrated, the cable 48 substantially blocks the tool receptacle portion 34 and the lateral receptacle portion 35, thereby blocking access to the lock screw 30. For example, the cable 48 blocks insertion of the tool 100 into the tool receptacle portion 34, such that the tip 106 of the tool 100 cannot engage or actuate the tool engagement portion 40 of the lock screw 30. In this manner, the lock insert 28 (e.g., the cable 48) substantially blocks tampering with the lock screw 30, thereby preventing unauthorized removal of the cover 14 from the container 12 without first removing the insert 28. If the lock insert 28 (e.g., cable 48) is removed, then it notifies authorized personnel that an unauthorized access may have occurred with the container system 10. Furthermore, if the lock insert 38 is removed and replaced with another lock insert 28, then the tag 54 may indicate whether or not the new lock insert 28 was authorized or unauthorized. For example, if the tag 54 does not include the correct information 56, then the incorrect tag 54 would notify authorized personnel of an unauthorized access (i.e., tampering with) the container system 10.

Figure 6:
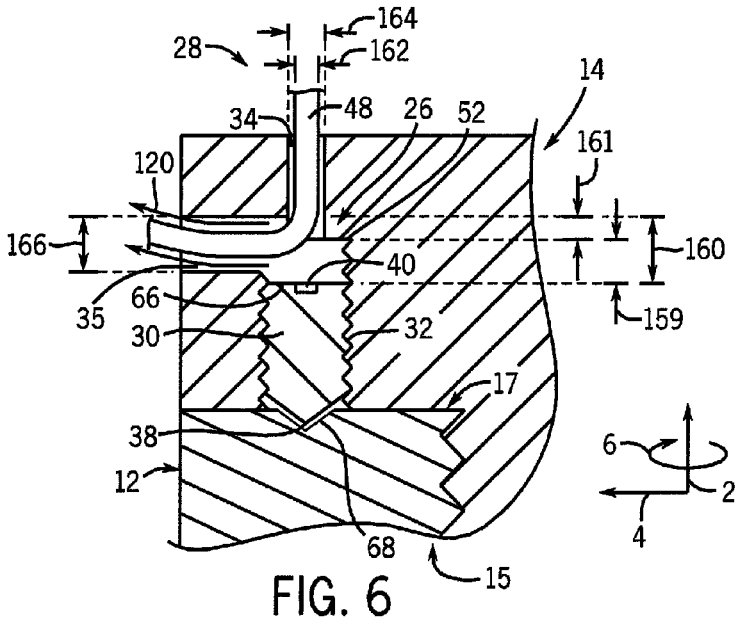
FIG. 6 is a partial cross-sectional side view taken within line 6-6 of FIG. 5, further illustrating the lock insert disabling the lock screw.

FIG. 6 is a partial cross-sectional side view taken within line 6-6 of FIG. 5, further illustrating the lock insert 28 disabling the lock screw 30. As previously discussed, the cover lock position 72 of the lock screw 30 opens the junction region 122 between the tool receptacle portion 34 and the lateral receptacle portion of the lock receptacle 26, thereby opening the pathway 120 to support the lock insert 28 (e.g., cable 48) above the lock screw 30. For example, the lock screw 30 may have a height selected to enable a clearance 160 after the lock screw 30 is engaged with the lock screw recess 68 in the container 12. In particular, the clearance 160 is sufficient to open the junction region 122 and open the pathway 120 for the cable 48. For example, the clearance 160 may include a distance 159 between the surface 66 of the lock screw 30 and the screw stop 52 as well as a distance 159 between the screw stop 52 and a corner of the receptacle portions 34 and 35. In the illustrated embodiment, the clearance 160 opens a single pathway 120 for the cable 48. In other embodiments, the lock receptacle 26 may include a plurality of lateral receptacle portions 35 to define a plurality of pathways 120 for multiple lock inserts 28 (e.g., tamper-proof cables 48).

As illustrated, the lock insert 28 (e.g., cable 48) substantially fills the tool receptacle portion 34. For example, the cable 48 has a diameter 162 that at least smaller than the diameter or width of the receptacle portions 34 and 35. For example, the diameter 162 may be approximately 1 to 50, 1 to 25, or 1 to 10 percent smaller than a diameter or width 164 of the tool receptacle portion 34 and a diameter or width 166 of the lateral receptacle portion 35. However, the diameter 162 of the cable 48 is large enough to block access by the tool 100. For example, the difference in diameters 162 and 164 may be less than the diameter of the shaft 104 of the tool 100, thereby blocking entry of the shaft 104 into the lock receptacle 26. When installed, the tamper-proof cable 48 blocks access to the tool engagement portion 40 of the lock screw 30 through the tool receptacle portion 34. Certain standards may be utilized in designing the tamper-proof cable 48. For example, the cable may be designed to conform to International Organization of Legal Metrology standards. In some embodiments, the tamper-proof cable 48 may be made of cut-resistant materials, such as a carbon-tempered steel composite cable. In other embodiments, the tamper-proof cable 48 may be designed with materials suitable for cutting, such as plastic.

Figure 7:
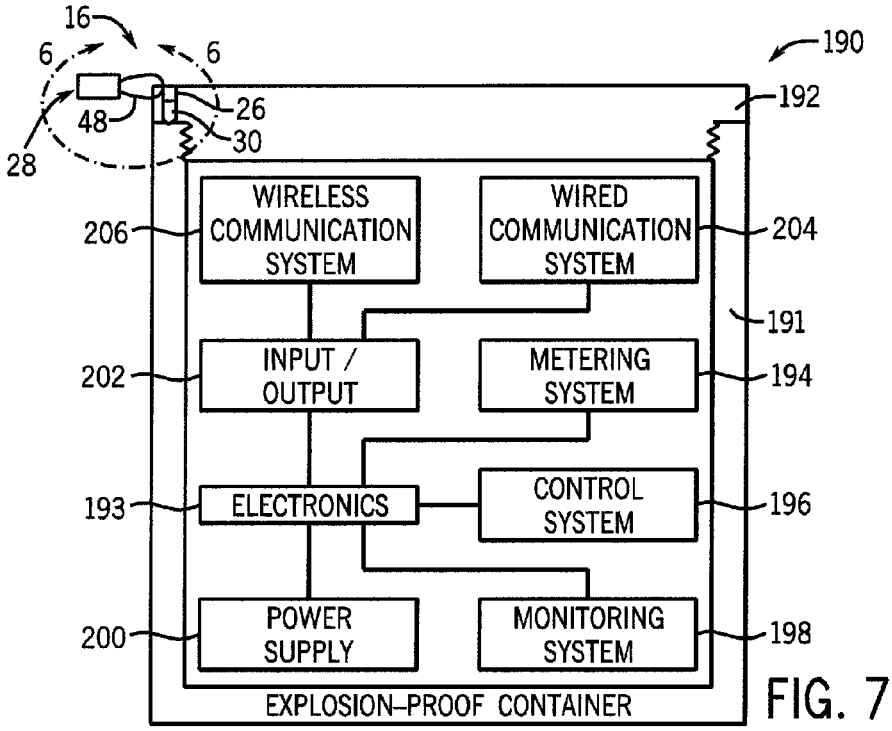
FIG. 7 is a schematic of an embodiment of an explosion-proof container having internal components protected by the cover lock assembly of FIGS. 1-6.

FIG. 7 is a schematic of an embodiment of an explosion-proof container assembly 190 having internal components protected by the cover lock assembly 16 of FIGS. 1-6. As illustrated, the explosion-proof container assembly 190 includes an explosion-proof container 191 and an explosion-proof cover 192. The explosion-proof container 191 may house electronics 193 coupled to a metering system 194, a control system 196, and a monitoring system 198. The electronics may be powered by a power supply 200, and may include a plurality of inputs/outputs 202. For example, the inputs/outputs 202 may be coupled to a wired communication system 204 and/or a wireless communications system 206. For various reasons, personnel may require that no un-authorized access be provided to the various components inside the explosion-proof container assembly 190. To prevent unauthorized access, the cover lock assembly 16 described above with reference to FIGS. 1-6 may be secured between the container 191 and the cover 192 to substantially block tampering with the internal components.

Figure 8:
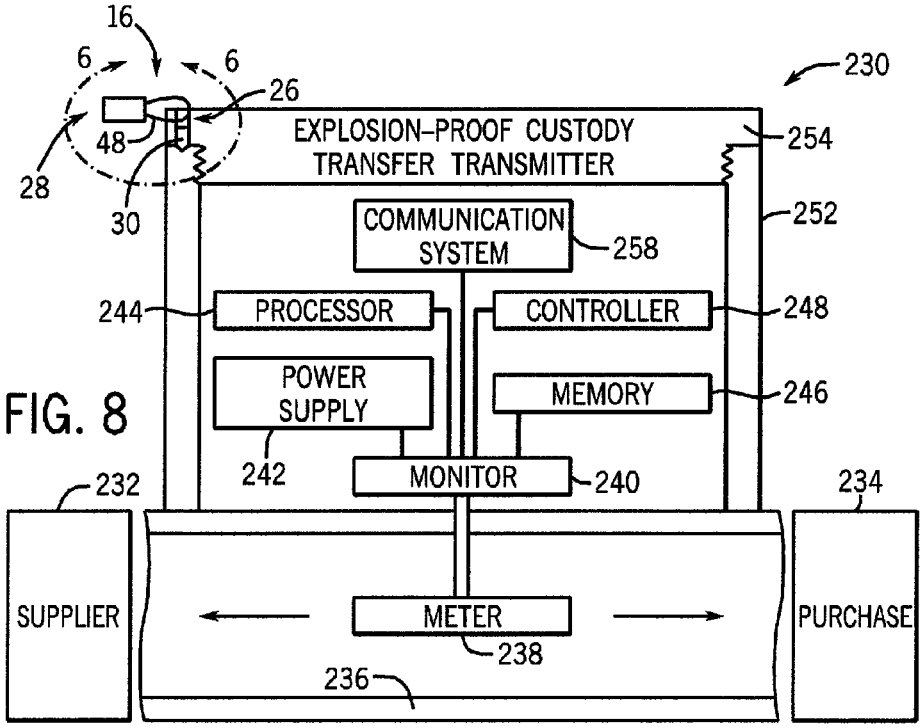
FIG. 8 is a schematic of an embodiment of an explosion-proof custody transfer transmitter having internal components protected by the cover lock assembly of FIGS. 1-6.

FIG. 8 is a schematic of an embodiment of an explosion-proof custody transfer transmitter 23 having internal components protected by the cover lock assembly 16. of FIGS. 1-6. In certain embodiments, the explosion-proof custody transfer transmitter 230 may be utilized in transferring resources from a supplier 232 to a purchaser 234. As resources flow via transport mechanism 236 (e.g., a pipeline), a metering system 238 provides a measurement of resources that have been transferred from the supplier 232 to the purchaser 234. For example, the metering system 238 may obtain measurements relating to a flow rate, a temperature, a pressure, a material composition, a viscosity, or any combination thereof. The metering system 238 provides the measurement data to a monitor 240, which may be coupled to a power supply 242, processor 244, memory 246, controller 248, and communication system 250. The processor 244 may execute instructions stored on the memory 246 to perform various monitoring, data acquisition, data processing, data storage, and reporting functions. For example, the processor 244 may process data from the monitor 240, which receives signals from the metering system 238. In turn, the communication system 250 may be employed to transmit and/or receive data (including the measurement data) with the supplier 232, the purchaser 234, and/or a remote location (e.g., a third party). Similar to the embodiment of FIG. 7, the communications system 250 may include a wired and/or wireless communication system. Furthermore, the controller 248 may be employed to control various equipment, such as valves, associated with the monitored data.

The metering data may be highly sensitive, as it provides an accounting of how much of a resource has been transferred from the supplier 232 to the purchaser 234. Furthermore, the explosion-proof custody transfer transmitter 230 may transport materials that may be potentially explosive, such as various fuels (e.g., liquid or gas fuels). Thus, the illustrated explosion-proof custody transfer transmitter 230 includes the cover lock assembly 16 of FIGS. 1-6 to block unauthorized access or tampering with the internal components, e.g., 240, 242, 244, 246, 248, and 250. For example, the cover lock assembly 16 may be secured between a container 252 and a cover 254 of the explosion-proof custody transfer transmitter 230 to substantially block tampering with the internal components.

Technical effects of the invention include a container assembly with a cover lock assembly. The container may be locked when a locking screw in the cover lock assembly is engaged. Furthermore, when disengaged, the locking screw is retained within the cover lock assembly, and is thus not easily lost. The cover lock assembly further includes a lock insert that restricts unauthorized disengagement of the locking screw within the cover lock assembly. For example, the container assembly may include an explosion-proof container, where access to the contents of the container is restricted. When engaged, a locking screw within the cover lock assembly of the explosion-proof container blocks rotational movement of the cover of the explosion-proof container. Furthermore, a lock insert blocks access to disengage the locking screw, without first removing the lock insert. As a result, unauthorized access to the container is discouraged and is more easily detectable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a container assembly comprising a cover threadingly couplable to a container along a threaded interface portion of an interface; and a cover lock assembly, comprising:

a lock screw configured to selectively move between a cover lock position and a cover release position, wherein the lock screw extends across the interface to resist threaded rotation of the cover relative to the container in the cover lock position, and the lock screw is recessed away from the interface to enable threaded rotation of the cover relative to the container in the cover release position;

a screw stop configured to block removal of the lock screw from one or more recesses in the cover when the cover is threadingly coupled to the container;

a lock receptacle disposed in the cover, wherein the lock screw is disposed in a threaded portion of the lock receptacle, a tool insertion portion of the lock receptacle extends from the threaded portion, and a lateral portion of the lock receptacle intersects the threaded portion and the tool insertion portion; and a lock insert configured to:

block movement of the lock screw from the cover lock position to the cover release position; and extend through the tool insertion portion and the lateral portion of the lock receptacle to block movement of the lock screw.

2. The system of claim 1, wherein the cover lock assembly is coupled to the cover.

3. The system of claim 2, wherein the lock screw is self-retained directly to the cover.

4. The system of claim 2, wherein the lock insert comprises a cable.

5. The system of claim 2, comprising a T-shaped lock receptacle supporting the lock screw and the lock insert.

6. The system of claim 1, wherein the threaded portion of the lock receptacle extends to the interface, the tool insertion portion of the lock receptacle extends to a surface opposite from the interface, and the screw stop is disposed between the tool insertion portion and the threaded portion.

7. The system of claim 6, wherein the screw stop comprises a ledge between the tool insertion portion and the threaded portion of the lock receptacle.

8. The system of claim 7, wherein the tool insertion portion has a first diameter smaller than a second diameter of the threaded portion, the first diameter forming the ledge.

9. The system of claim 8, wherein the lock insert comprises a closed loop extending through the lateral portion and the tool insertion portion of the lock receptacle.

10. The system of claim 1, wherein the interface comprises a non-threaded interface portion, and the lock screw is configure to selectively extend across the non-threaded interface portion.

11. The system of claim 1, wherein the container assembly comprises an explosion proof container assembly that contains electronics.

12. A system, comprising:

an explosion proof container assembly, comprising:

a container; and a cover threaded to the container, wherein the cover comprises a lock receptacle having a threaded portion extending to an interface between the container and the cover, a tool insertion portion extending from the threaded portion to a surface opposite from the interface, and a screw stop disposed between the threaded portion and the tool insertion portion; and a cover lock assembly, comprising:

a lock screw disposed in the threaded portion of the lock receptacle, wherein the lock screw is configured to selectively move across the interface to resist rotation of the cover relative to the container, and the screw stop blocks removal of the lock screw through the tool insertion portion.

13. The system of claim 12, wherein the tool insertion portion has a first diameter smaller than a second diameter of the threaded portion.

14. The system of claim 12, wherein the cover lock assembly comprises a lock insert configured to extend into the tool insertion portion to block removal of the lock screw.

15. The system of claim 12, wherein lock receptacle comprises a lateral portion, and the cover lock assembly comprises a lock insert configured to extend through the tool insert portion and the lateral portion to block removal of the lock screw.

16. A system, comprising:

a cover configured to couple to a container along an interface with a fastening mechanism, wherein the cover comprises a lock receptacle having a threaded portion extending to the interface, a tool insertion portion extending from the threaded portion to a surface opposite from the interface, a lateral portion intersecting at least one of the threaded portion or the tool insertion portion, and a screw stop; and a cover lock assembly separate from the fastening mechanism, wherein the cover lock assembly comprises:

a lock screw disposed in the threaded portion of the lock receptacle, wherein the lock screw is configured to selectively move across the interface to block removal of the cover relative to the container via the fastening mechanism, and the screw stop blocks removal of the lock screw through the tool insertion portion; and a lock insert comprising a cable configured to extend through the tool insertion portion and the lateral portion of the lock receptacle, wherein the cable is configured to block a tool from engaging the lock screw through the tool insertion portion of the lock receptacle.

17. The system of claim 16, wherein the cover comprises an explosion proof cover.

18. The system of claim 16, comprising a custody transfer transmitter having the cover, the container, and the cover lock assembly.

19. The system of claim 16, comprising a custody transfer transmitter having the cover, the container, and the cover lock assembly.

20. The system of claim 1, wherein the lock screw is threaded to the cover, and the lock screw extends between the interface and the screw stop.

* * * * *